US011283212B2

(12) United States Patent
Ando

(10) Patent No.: US 11,283,212 B2
(45) Date of Patent: Mar. 22, 2022

(54) CONNECTOR

(71) Applicant: SUMITOMO WIRING SYSTEMS, LTD., Mie (JP)

(72) Inventor: Motohiro Ando, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/047,528

(22) PCT Filed: Apr. 10, 2019

(86) PCT No.: PCT/JP2019/015598
§ 371 (c)(1),
(2) Date: Oct. 14, 2020

(87) PCT Pub. No.: WO2019/208220
PCT Pub. Date: Oct. 31, 2019

(65) Prior Publication Data

US 2021/0119369 A1 Apr. 22, 2021

(30) Foreign Application Priority Data

Apr. 26, 2018 (JP) ..... JP2018-084888

(51) Int. Cl.
*H01R 13/506* (2006.01)
*H01R 13/405* (2006.01)
*H01R 13/627* (2006.01)
*H01R 13/639* (2006.01)

(52) U.S. Cl.
CPC ..... *H01R 13/506* (2013.01); *H01R 13/405* (2013.01); *H01R 13/627* (2013.01); *H01R 13/639* (2013.01)

(58) Field of Classification Search
CPC .. H01R 13/506; H01R 13/405; H01R 13/627; H01R 13/639
See application file for complete search history.

(56) References Cited

U.S. PATENT DOCUMENTS 4,085,991 A * 4/1978 Marshall ..... H01R 13/20 439/346
8,840,418 B2 * 9/2014 Chien ..... H01R 13/635 439/346
2003/0207606 A1 * 11/2003 Ho ..... H01R 13/20 439/346

(Continued)

FOREIGN PATENT DOCUMENTS

JP 2011-034937 A 2/2011
JP 2011-238483 A 11/2011
JP 2017-152093 A 8/2017

OTHER PUBLICATIONS

International Search Report dated May 28, 2019 for WO 2019/208220 A1 (3 pages).

*Primary Examiner* — Tho D Ta
(74) *Attorney, Agent, or Firm* — Abelman, Frayne & Schwab

(57) ABSTRACT

A connector 10 disclosed by this specification includes a housing 12 including a busbar 30 and a mounting member to be mounted into the housing 12. The housing 12 includes a first lock portion 38. The mounting member includes a second lock portion 60 to be engaged with the first lock portion 38. The first lock portion 38 is provided on the side of an exposed surface 36 of the busbar 30.

8 Claims, 10 Drawing Sheets

(56) References Cited

U.S. PATENT DOCUMENTS

2008/0064248 A1* 3/2008 Huang ..... H01R 13/639
439/346
2013/0322049 A1 12/2013 Ishikawa et al.

* cited by examiner

CONNECTOR

CROSS REFERENCE TO RELATED APPLICATIONS

This application is a national phase of PCT application No. PCT/JP2019/015598, filed on 10 Apr. 2019, which claims priority from Japanese patent application No. 2018-084888, filed on 26 Apr. 2018, all of which are incorporated herein by reference.

TECHNICAL FIELD

A technique disclosed by this specification relates to a connector.

BACKGROUND

A connector described in Japanese Patent Laid-Open Publication No. 2011-034937 is, for example, known as a conventional connector. This connector is composed of a first connector and a second connector to be connected to the first connector.

The first connector includes a receptacle open in a connecting direction, and the second connector is accommodated into the receptacle of the first connector at the time of connection and includes a receptacle open in the connecting direction.

A fitting hole is provided to be open in the receptacle of the first connector, and a fitting projection to be fit into the fitting hole of the first connector and locked at the time of connection is provided to project on an outer surface of the receptacle of the second connector. Further, on an inner surface of a back side of the fitting projection of the receptacle of the second connector, a second terminal fitting is provided to extend in the connecting direction along the inner surface.

PRIOR ART DOCUMENT

Patent Document

Patent Document 1: Japanese Patent Laid-Open Publication No 2011-034937A

SUMMARY OF THE INVENTION

Problems to be Solved

However, the fitting projection and the second terminal fitting are separated by a resin thickness of the second receptacle and there is a problem that the connector is enlarged by that resin thickness.

Means to Solve the Problem

A connector disclosed in this specification is provided with a housing including a busbar, and a mounting member to be mounted into the housing, wherein the housing includes a first lock portion, the mounting member includes a second lock portion to be engaged with the first lock portion, and the first lock portion is provided on an exposed surface side of the busbar.

The first lock portion of the housing is provided on the exposed surface side of the busbar. Thus, as compared to a configuration in which a first lock portion is not exposed on an exposed surface side because a resin wall is formed between the first lock portion and an exposed surface of the busbar, the housing can be reduced in size by a thickness of the resin wall. Therefore, the connector can be reduced in size.

Further, the second lock portion may be provided at a position facing an exposed surface of the busbar.

The second lock portion is provided at the position facing the exposed surface of the busbar. Thus, for example, as compared to a configuration in which a first lock portion is provided on an end part of an exposed surface of a busbar and a second lock portion is located in front of the end part of the exposed surface in a connecting direction and provided to face an inner wall of a housing, the housing and a retainer can be reduced in size by a length of the second lock portion.

Further, the first lock portion may be provided on at least a part of the exposed surface of the busbar.

The first lock portion is provided on at least the part of the exposed surface of the busbar. Thus, for example, as compared to a configuration in which a resin wall is provided between a first lock portion and an exposed surface of a busbar and the first lock portion is not directly provided on the exposed surface of the busbar, the housing can be reduced in size by a resin thickness of the resin wall.

Further, a connector disclosed in this specification is provided with a housing made of resin, a busbar made of conductive metal, the busbar being embodied in the housing, and a separate mounting member to be mounted into the housing, wherein a first lock portion is provided to project in the housing, the mounting member is provided with a second lock portion for locking the mounting member in the housing by coming into contact with the first lock portion, a plate surface of the busbar has an exposed surface exposed to outside, and the first lock portion is integrated with the housing and directly provided on the exposed surface of the busbar.

The first lock portion of the housing is directly provided on the exposed surface of the busbar. Thus, as compared to a configuration in which a resin wall of a housing is provided between a first lock portion and a busbar as before, the housing can be reduced in size by a resin thickness of the resin wall because no resin wall is provided. Therefore, the connector can be reduced in size.

Further, the housing may be provided with holding walls connected to both side surfaces of the first lock portion intersecting a mounting direction of the mounting member.

By providing the holding walls on the both side surfaces of the first lock portion, the first lock portion is held on the holding walls even if the second lock portion strongly contacts the first lock portion when the mounting member is mounted. Thus, the breakage of the first lock portion is suppressed.

Further, the mounting member may include a lock arm cantilevered in a mounting direction into the housing, and the second lock portion may be provided to project in a direction from an end part of the lock arm toward the exposed surface of the busbar.

By providing the second lock portion on the end part of the cantilevered lock arm, the lock arm is deflected if the second lock portion contacts the first lock portion when the mounting member is mounted into the housing. Thus, the mounting member is easily mounted into the housing.

Further, a pair of the lock arms may be provided and facing each other, the second lock portion may be provided on one of the lock arms and provided to project in a direction opposite to a direction toward the facing other lock arm, a third lock portion may be provided to project in the housing, and the other lock arm may be provided with a fourth lock portion projecting from an end part of the other lock arm in a direction opposite to a direction toward the facing one lock arm and configured to lock the mounting member in the housing by coming into contact with the third lock portion.

Since the mounting member is locked in contact with the first and third lock portions of the housing by the second and fourth lock portions provided on the end parts of the pair of lock arms, the mounting member is less likely to be detached from the housing as compared to a configuration in which only one lock arm is provided.

Further, the first lock portion may be provided with a first tapered surface inclined from an end part in a projecting direction of the first lock portion toward the exposed surface of the busbar in a direction opposite to the mounting direction of the mounting member.

By providing the first tapered surface on the first lock portion, the first tapered surface of the first lock portion and the second lock portion slide on each other and the lock arm provided with the second lock portion is easily deflected in the projecting direction of the first lock portion when the mounting member is mounted into the housing. Thus, the mounting member is easily mounted into the housing.

Further, the second lock portion may be provided with a second tapered surface inclined from an end part in a projecting direction of the second lock portion toward a tip part of the lock arm in the mounting direction of the mounting member.

By providing the second tapered surface on the second lock portion, the second tapered surface of the second lock portion and the first lock portion slide on each other and the lock arm provided with the second lock portion is easily deflected in the projecting direction of the first lock portion when the mounting member is mounted into the housing. Thus, the mounting member is easily mounted into the housing.

Effect of the Invention

The connector disclosed in this specification can be reduced in size.

DETAILED DESCRIPTION TO EXECUTE THE INVENTION

Embodiment

An embodiment is described with reference to FIGS. 1 to 10. In the following description, a Z direction, an X direction and a Y direction of FIGS. 1 to 10 are referred to as an upward direction, a forward direction and a rightward direction.

Figure 1:
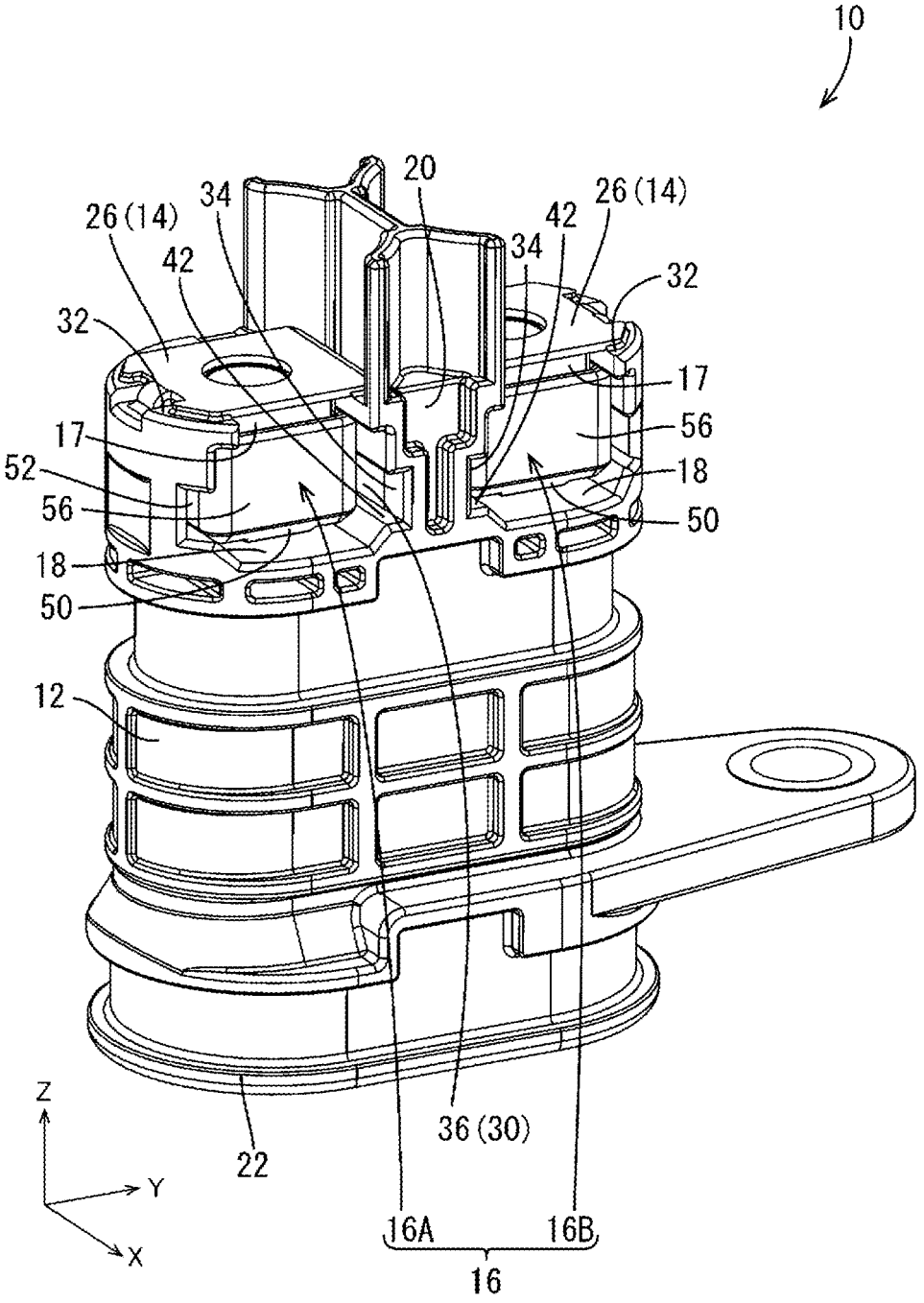
FIG. 1 is a perspective view of a connector in an embodiment.
Figure 2:
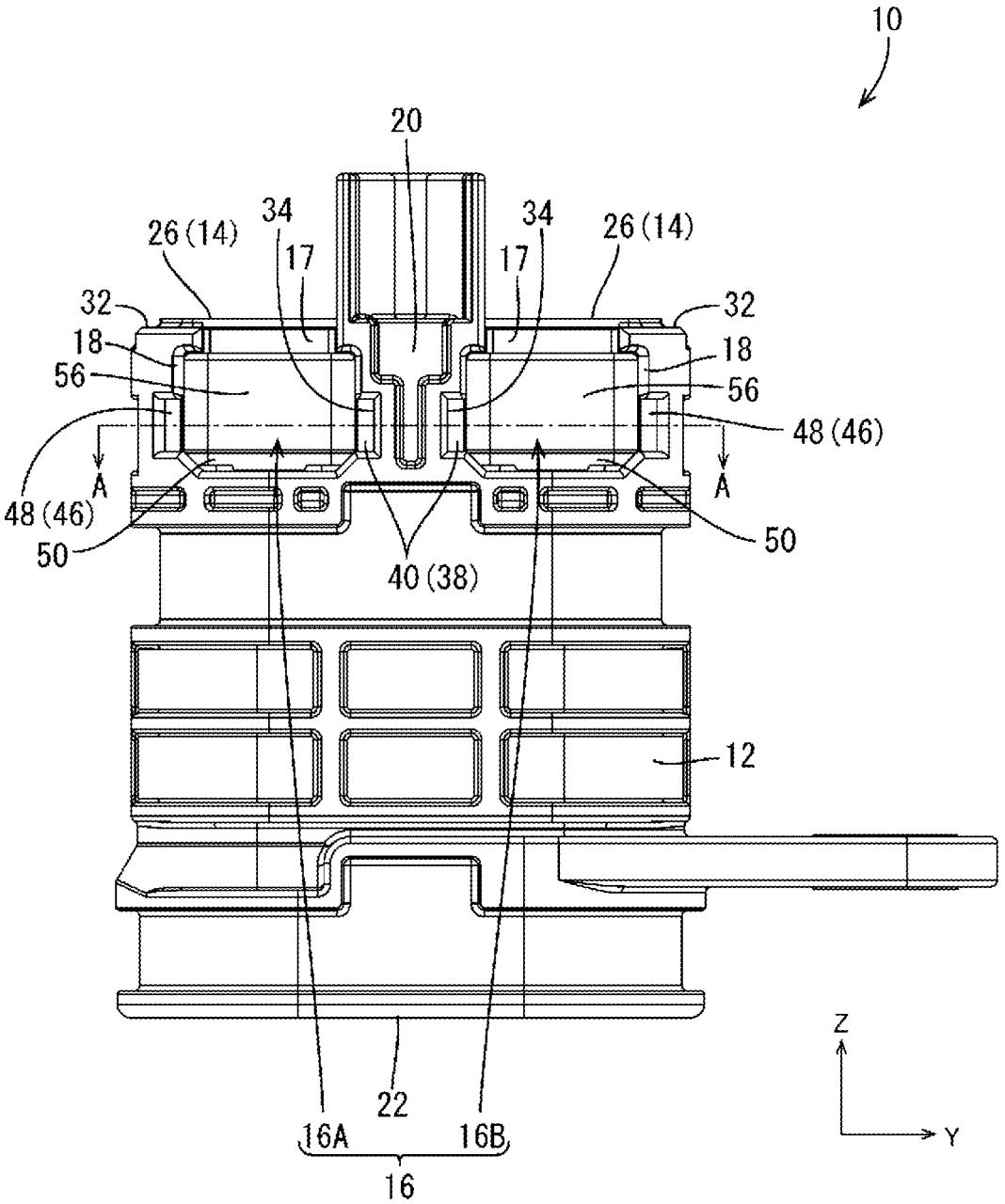
FIG. 2 is a front view of the connector.
Figure 4:
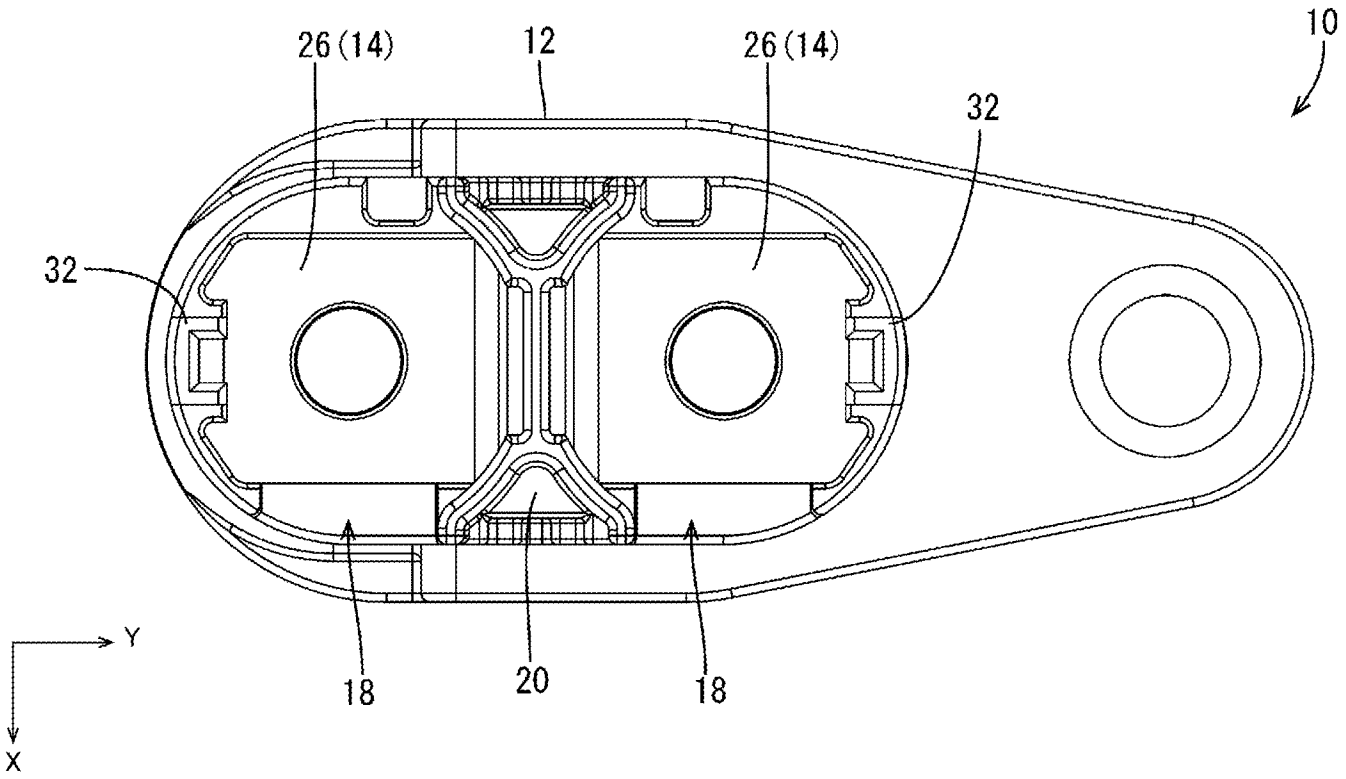
FIG. 4 is a back view of the connector.

A connector 10 of this embodiment is a connector connecting a battery of a vehicle and a PCU (Power Control Unit) and includes, as shown in FIGS. 1, 2 and 4, a housing 12 made of resin and having a cylindrical shape elliptical in a plan view, a pair of left and right terminals 14 made of conductive metal and fixed in the housing 12 by insert molding, and a pair of retainers (mounting members) 16 separate from the housing 12. The pair of retainers 16 are retainers for holding square nuts 17 in the housing 12 and respectively mounted in the housing 12 with the square nuts 17 accommodated inside.

Figure 3:
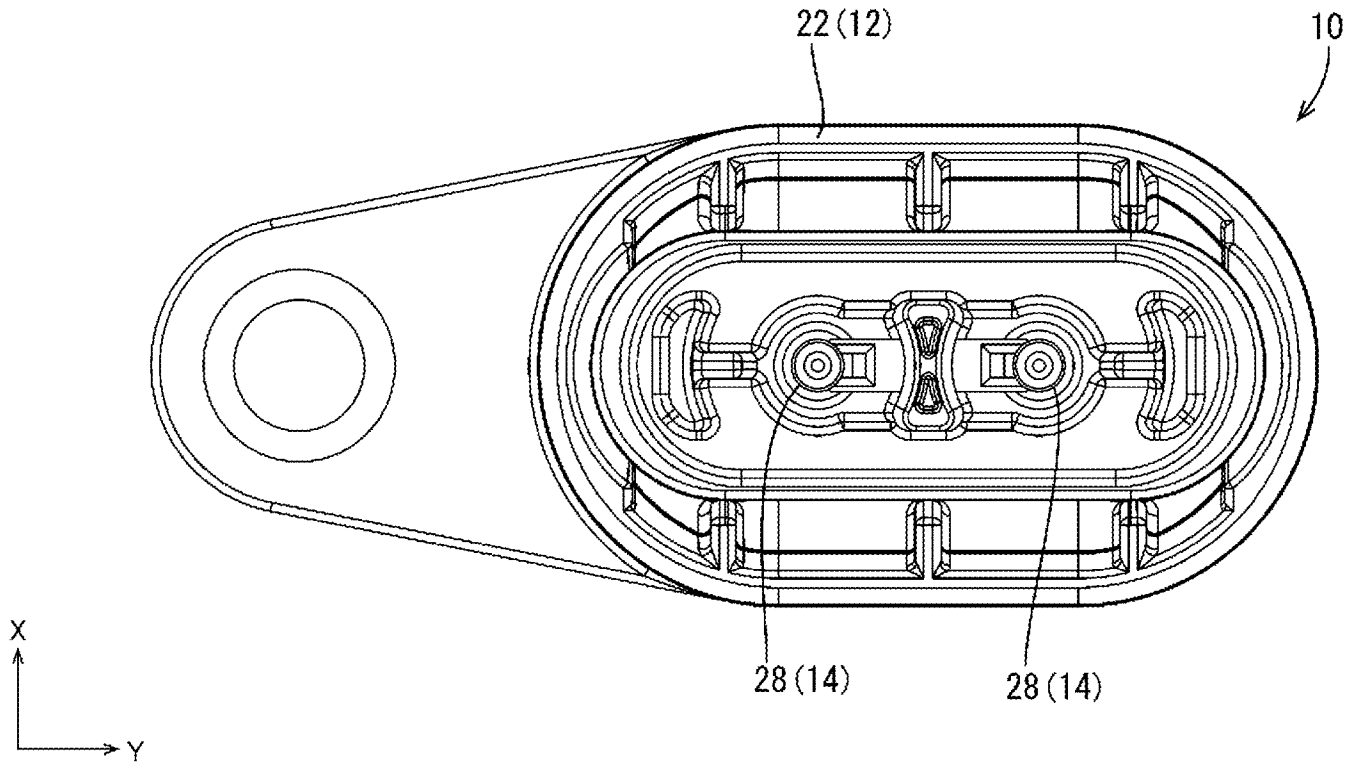
FIG. 3 is a plan view of the connector.

As shown in FIGS. 1 and 2, a pair of left and right accommodating portions 18 for respectively accommodating the pair of retainers 16 are provided in an upper part of the housing 12, and a partition wall 20 is provided between the pair of accommodating portions 18. The pair of accommodating portions 18 are open forward and upward, and the pair of retainers 16 are respectively inserted through front openings of the pair of accommodating portions 18. As shown in FIGS. 1 and 3, a receptacle 22 open downward is provided in a lower part of the housing 12.

Each of the pair of terminals 14 is plate-like and includes a first connecting portion 26 (shown in FIG. 1) having a connection hole open in a center, a second connecting portion 28 (shown in FIG. 3) having a hollow cylindrical shape long in a vertical direction, and a busbar 30 (shown in FIGS. 1 and 5) coupling the first and second connecting portions 26, 28.

As shown in FIGS. 1 and 2, a pair of the first connecting portions 26 are respectively provided on opening edges 32 of upper openings of the left and right accommodating portions 18 of the housing 12. The pair of busbars 30 are embedded in the partition wall 20 and respectively connected to side edges of the pair of first connecting portions 26. The pair of busbars 30 are disposed at a predetermined interval in a lateral direction in the partition wall 20, and the pair of terminals 14 are electrically insulated from each other by the partition wall 20.

As shown in FIG. 3, a pair of the second connecting portions 28 are provided in the receptacle 22 and disposed at a predetermined interval in the lateral direction. The pair of second connecting portions 28 and the pair of busbars 30 are respectively connected, and the pair of first connecting portions 26 and the pair of second connecting portions 28 are respectively electrically connected via the pair of busbars 30.

Figure 5:
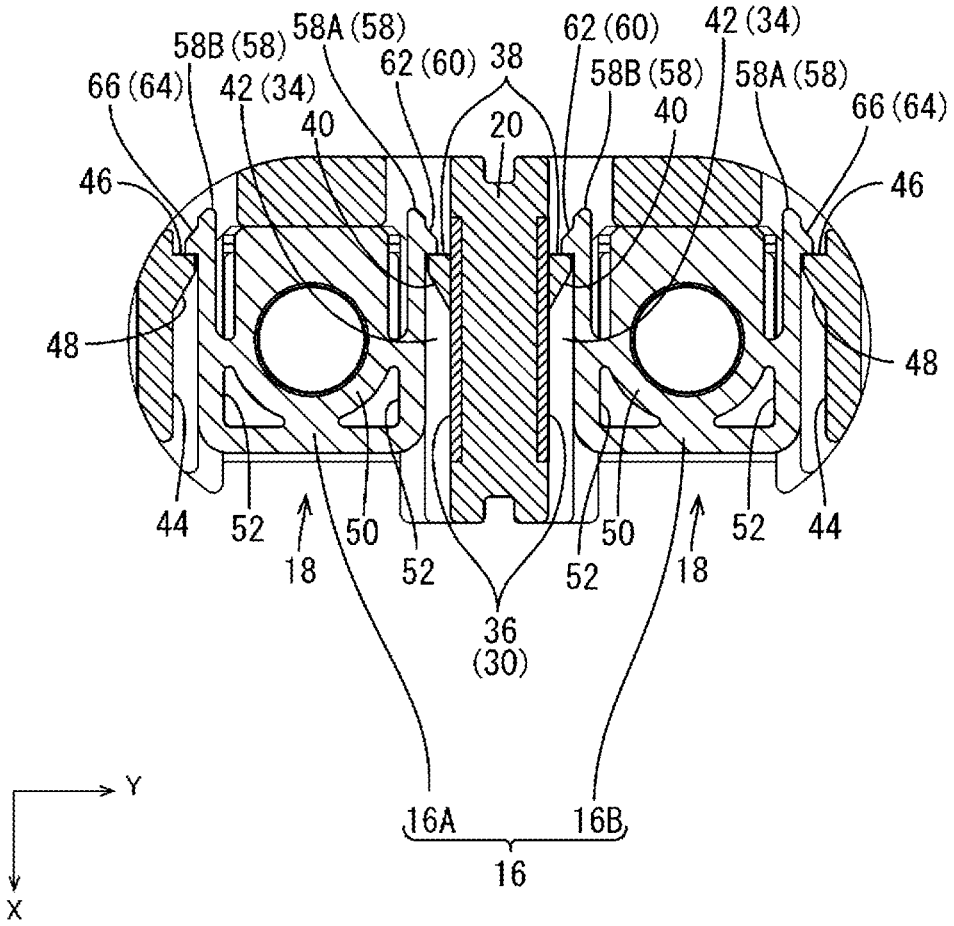
FIG. 5 is a section along A-A in FIG. 2.

As shown in FIGS. 1 and 2, a pair of concave groove portions 34 are respectively provided in both left and right side surfaces of the partition wall 20. As shown in FIGS. 1 and 5, exposed surfaces 36 formed by partially exposed plate surfaces of the pair of busbars 30 are respectively provided on the bottom surfaces (i.e. lateral surfaces) of the pair of groove portions 34.

Figure 6:
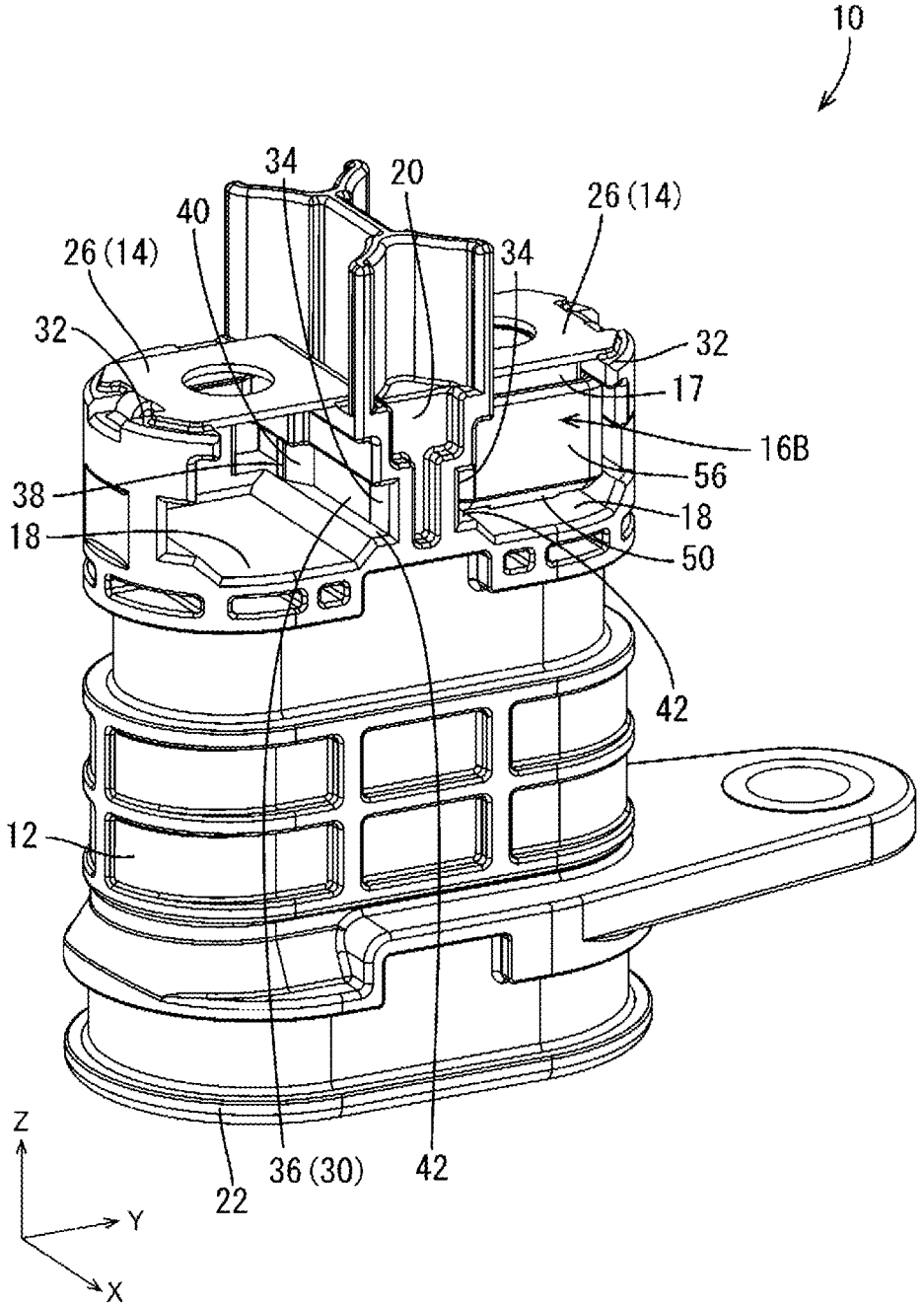
FIG. 6 is a perspective view of the connector in a state before one retainer is mounted.

As shown in FIGS. 5 and 6, a pair of first lock portions 38 are respectively provided to project inwardly (leftwardly and rightwardly) of the pair of accommodating portions 18. The pair of first lock portions 38 are integrally formed to the housing 12 during insert molding, and located on the sides of the exposed surfaces 36 of the pair of busbars 30. Further, the first lock portions 38 are provided on at least parts of the exposed surfaces 36 of the pair of busbars 30 and directly provided on the exposed surfaces 36. The first lock portions 38 of the housing 12 are directly provided on the exposed surfaces 36 of the busbars 30 in this way. Thus, as compared to a configuration in which resin walls are provided between first lock portions and busbars as before, the housing 12 can be reduced in size by resin thicknesses of the resin walls because no resin wall is provided.

Figure 7:
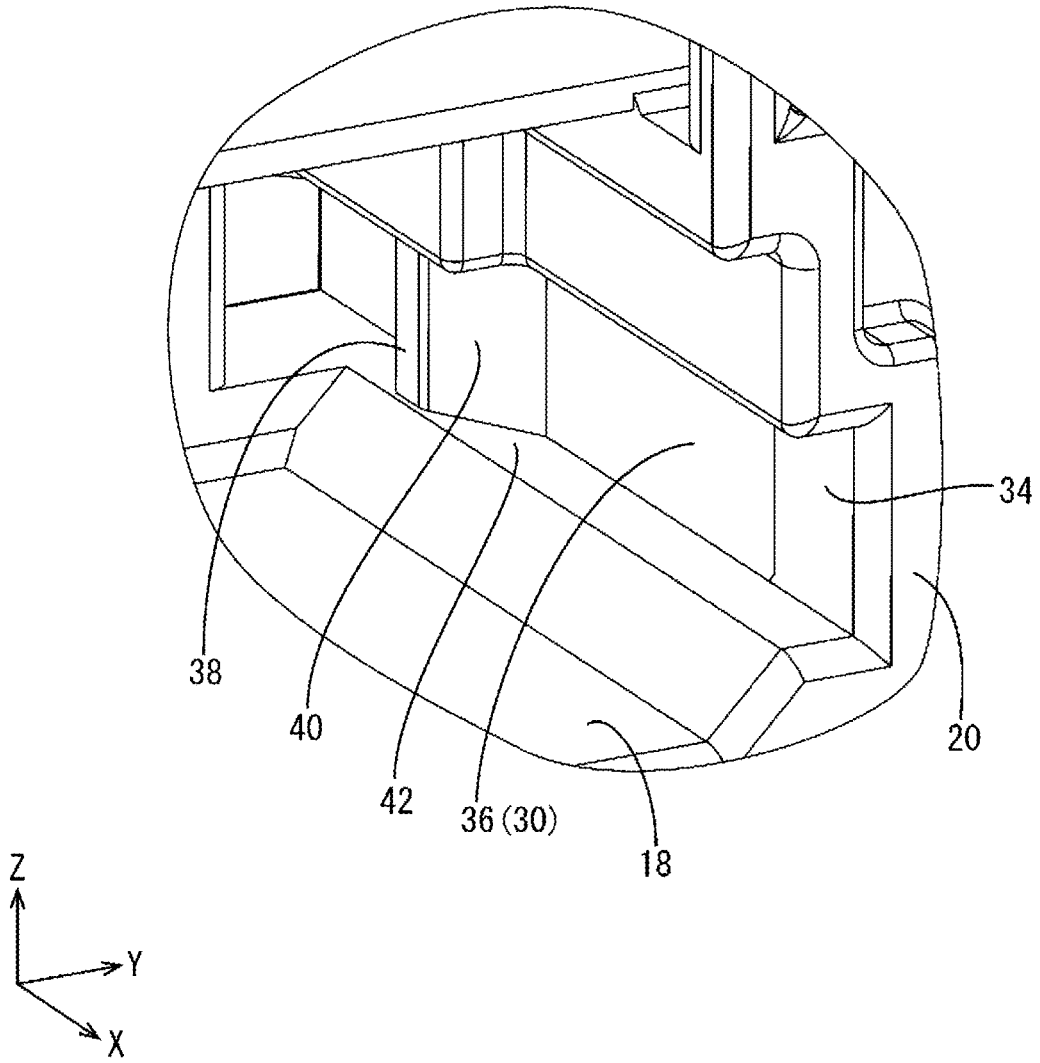
FIG. 7 is an enlarged view near an exposed surface of a busbar in FIG. 6.
Figure 8:
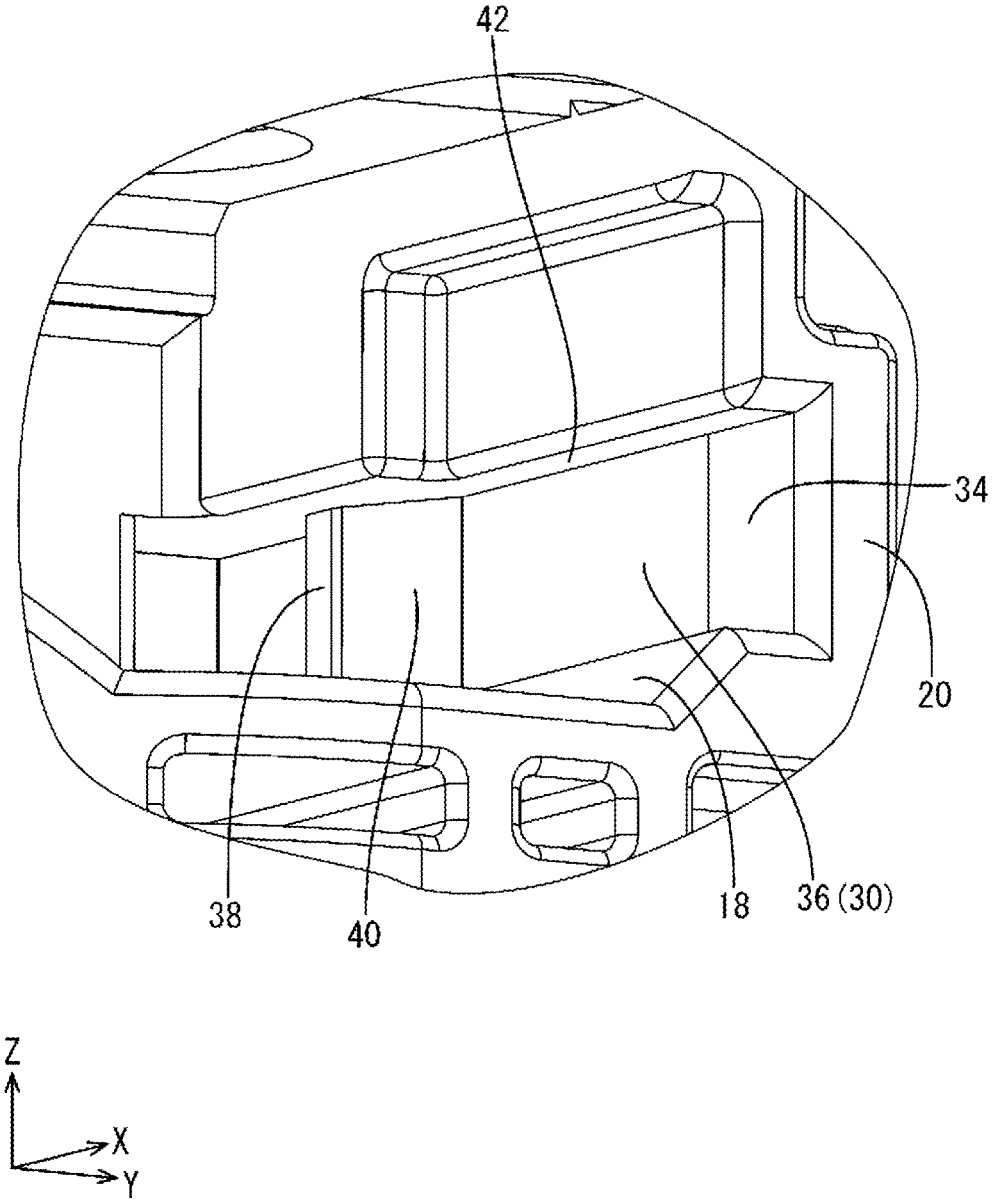
FIG. 8 is a view showing the exposed surface of the busbar in FIG. 7 when viewed from a different angle.

The first lock portion 38 is provided with a first tapered surface 40 inclined forward from an end part in a projecting direction of the first lock portion 38 toward the exposed surface 36. Further, as shown in FIGS. 7 and 8, the upper and lower surfaces of the first lock portion 38 are connected to the upper and lower surfaces of the groove portion 34, and the upper and lower surfaces of the groove portion 34 serve as a pair of upper and lower holding walls 42 for respectively holding the first lock portion 38 by being connected to the first lock portion 38.

As shown in FIG. 5, a pair of third lock portions 46 are respectively provided to project toward the pair of first lock portions 38 on facing surfaces 44 facing the partition wall 20 in the pair of accommodating portions 18. The third lock portion 46 is provided at a position facing the first lock portion 38, and the third lock portion 46 is provided with a third tapered surface 48 inclined forward from an end part in a projecting direction of the third lock portion 46 toward the facing surface 44.

Figure 9:
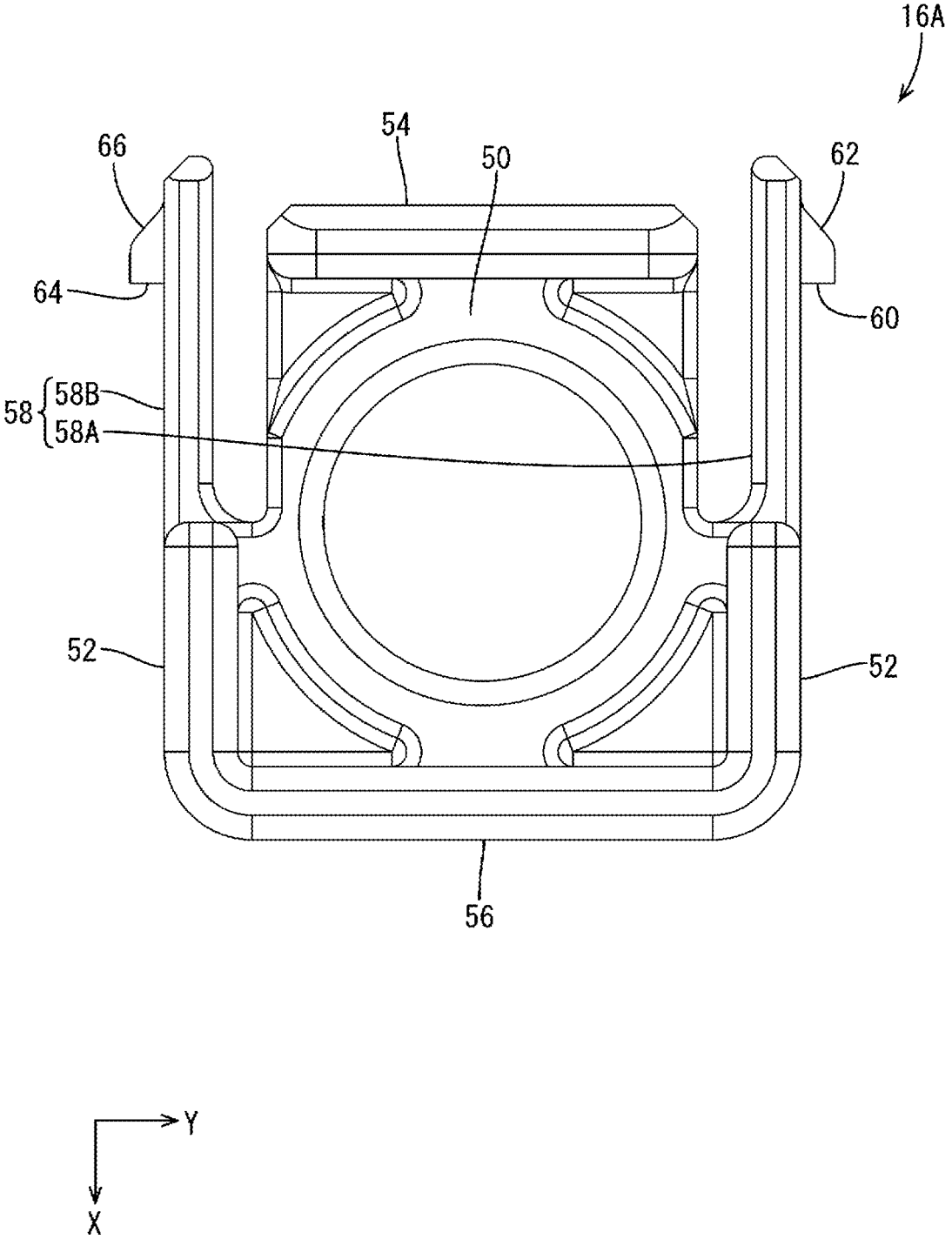
FIG. 9 is a plan view of a left retainer.
Figure 10:
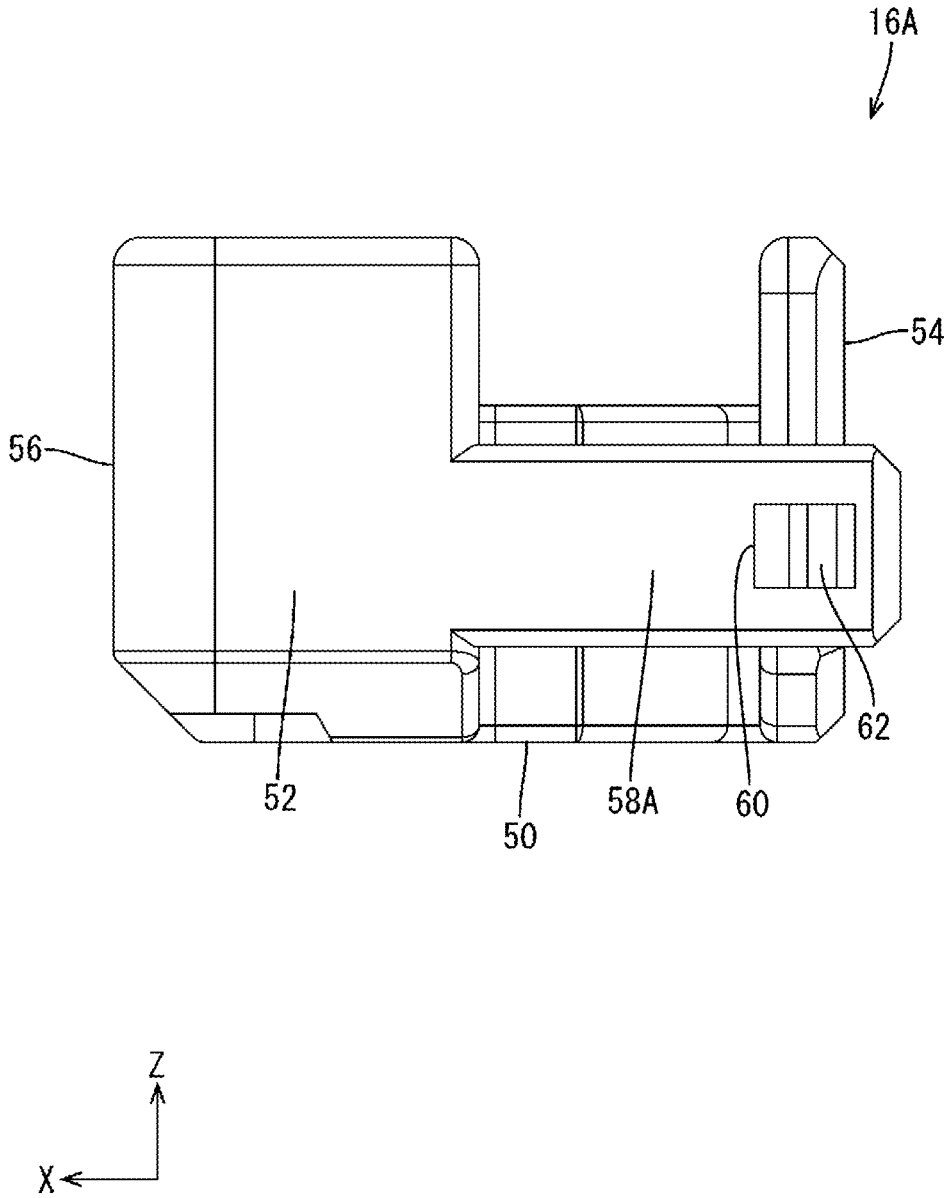
FIG. 10 is a side view of the left retainer.

Out of the pair of retainers 16, the left retainer 16A to be accommodated into the left accommodating portion 18 is described. As shown in FIGS. 9 and 10, the left retainer 16A is in the form of a box with an open upper side and composed of a bottom wall portion 50 constituting a bottom surface, a pair of side wall portions 52 constituting both left and right side surfaces, a rear wall portion 54 constituting a rear surface, a front wall portion 56 constituting a front surface and a pair of left and right lock arms 58.

The pair of left and right lock arms 58 are respectively cantilevered rearward from rear end parts of the pair of side wall portions 52.

Out of the pair of left and right lock arms 58, the right lock arm 58A is provided with a second lock portion 60 projecting rightward from the right surface of the right lock arm 58A. The second lock portion 60 is engaged with the first lock portion 38. With the second lock portion 60 engaged with the first lock portion 38, the second lock portion 60 is facing the exposed surface 36 of the busbar 30. The second lock portion 60 is provided with a second tapered surface 62 inclined toward a rear end part of the right lock arm 58A from a right end part of the second lock portion 60.

Out of the pair of left and right lock arms 58, the left lock arm 58B is provided with a fourth lock portion 64 projecting leftward from the left surface of the left lock arm 58B. The fourth lock portion 64 is provided with a fourth tapered surface 66 inclined toward a rear end part of the left lock arm 58B from a left end part of the fourth lock portion 64.

The right retainer 16B to be accommodated into the right accommodating portion 18 differs from the left retainer 16A in that a second lock portion 60 is provided on a left lock arm 58B and a fourth lock portion 64 is provided on a right lock arm 58A. The configuration other than those is the same as that of the left retainer 16A.

Next, functions of this embodiment are described.

If the left retainer 16A is inserted into the left accommodating portion 18 through the front opening of the left accommodating portion 18 in a state where the left retainer 16A is not accommodated in the left accommodating portion 18 (state shown in FIG. 6), the second lock portion 60 of the right lock arm 58A comes into contact with the first lock portion 38 of the housing 12 from front and the fourth lock portion 64 of the left lock arm 58B comes into contact with the third lock portion 46 of the housing 12 from front. At this time, the second lock portion 60 of the right lock arm 58 strongly comes into contact with the first lock portion 38 of the housing 12 from front, whereby a load is applied to the first lock portion 38 of the housing 12. However, since the first lock portion 38 is held on the holding walls 42 by having the upper and lower surfaces thereof connected to the holding walls 42 as shown in FIGS. 7 and 8, the breakage of the first lock portion 38 is suppressed.

If the left retainer 16A is pushed further rearward, the second tapered surface 62 of the second lock portion 60 of the right lock arm 58A slides on the first tapered surface 40 of the first lock portion 38 of the housing 12 and the right lock arm 58A is deflected leftward. At this time, since the second tapered surface 62 is provided on the second lock portion 60 of the right lock arm 58A and the first tapered surface 40 is provided on the first lock portion 38 of the housing 12, the right lock arm 58A is easily deflected leftward. Further, the fourth tapered surface 66 of the fourth lock portion 64 of the left lock arm 58B slides on the third tapered surface 48 of the third lock portion 46 of the housing 12 and the left lock arm 58B is deflected rightward. At this time, since the fourth tapered surface 66 is provided on the fourth lock portion 64 of the left lock arm 58B and the third tapered surface 48 is provided on the third lock portion 46 of the housing 12, the left lock arm 58B is easily deflected rightward.

If the left retainer 16A is inserted further rearward, the second lock portion 60 of the right lock arm 58A climbs over the first lock portion 38 and the fourth lock portion 64 of the left lock arm 58B climbs over the third lock portion 46 of the housing 12, whereby the deflection of the pair of lock arms 58 is restored. In this way, the second lock portion 60 of the right lock arm 58A can come into contact with the first lock portion 38 of the housing 12 from behind and the fourth lock portion 64 of the left lock arm 58B can come into contact with the third lock portion 46 of the housing 12 from behind as shown in FIG. 5. In this way, the left retainer 16A is locked while being prevented from coming out forward from the housing 12, and the square nut 17 accommodated in the left retainer 16A can be held in the housing 12.

As described above, according to this embodiment, the first lock portions 38 of the housing 12 are provided on the sides of the exposed surfaces 36 of the busbars 30. Thus, for example, as compared to a configuration in which first lock portions are not located on the sides of exposed surfaces of busbars because resin walls are formed between the first lock portions and the exposed surfaces of the busbars, the housing 12 can be reduced in size by thicknesses of the resin walls. Therefore, the connector 10 can be reduced in size.

Further, the second lock portions 60 are provided at the positions facing the exposed surfaces 36 of the busbars 30. Thus, for example, as compared to a configuration in which first lock portions are provided on end parts of exposed surfaces of busbars and second lock portions are located in front of the end parts of the exposed surfaces in a connecting direction and provided to face an inner wall of a housing, the housing 12 and the retainers 16 can be reduced in size by a length of the second lock portions 60.

Further, the first lock portions 38 are provided on at least parts of the exposed surfaces 36 of the busbars 30. Thus, for example, as compared to a configuration in which resin walls are provided between first lock portions and exposed surfaces of busbars and the first lock portions are not directly provided on the exposed surfaces of the busbars, the housing 12 can be reduced in size by resin thicknesses of the resin walls.

The first lock portions 38 of the housing 12 are directly provided on the exposed surfaces 36 of the busbars 30. Thus, as compared to a configuration in which resin walls of a housing are provided between first lock portions and busbars as before, the housing 12 can be reduced in size by resin thicknesses of the resin walls because no resin wall is provided. Therefore, the connector 10 can be reduced in size.

Further, by providing the holding walls 42 on both side surfaces of the first lock portion 38, the first lock portion 38 is held on the holding walls 42 even if the second lock portion 60 strongly contacts the first lock portion 38 when the retainer 16 is mounted. Thus, the breakage of the first lock portion 38 is suppressed.

Further, by providing the second lock portion 60 on the end part of the cantilevered lock arm 58, the lock arm 58 is deflected if the second lock portion 60 contacts the first lock portion 38 when the retainer 16 is mounted into the housing 12. Thus, the retainer 16 is easily mounted into the housing 12.

Further, the retainer 16 is locked in contact with the first and third lock portions 38, 46 of the housing 12 by the second and fourth lock portions 60, 64 provided on the end parts of the pair of lock arms 58. Thus, the retainer 16 is less likely to be detached from the housing 12 as compared to a configuration in which only one lock arm 58 is provided.

Further, by providing the first tapered surface 40 on the first lock portion 38, the first tapered surface 40 of the first lock portion 38 and the second lock portion 60 slide on each other and the lock arm 58 provided with the second lock portion 60 is easily deflected in the projecting direction of the first lock portion 38 when the retainer 16 is mounted into the housing 12. Thus, the retainer 16 is easily mounted into the housing 12.

By providing the second tapered surface 62 on the second lock portion 60, the second tapered surface 62 of the second lock portion 60 and the first lock portion 38 slide on each other and the lock arm 58 provided with the second lock portion 60 is easily deflected in the projecting direction of the first lock portion 38 when the retainer 16 is mounted into the housing 12. Thus, the retainer 16 is easily mounted into the housing 12.

Other Embodiments

The technique disclosed by this specification is not limited to the above described and illustrated embodiment. For example, the following modes are also included.

(1) Although the mounting member is the retainer 16 for holding the square nut 17 in the housing 12 in the above embodiment, the mounting member may be any separate component to be mounted into the housing 12. For example, the mounting member may be a retainer for holding a seal ring in a housing by coming into contact with the seal ring.

(2) Although the second lock portion 60 is provided to project on the lock arm 58 in the above embodiment, a second lock portion may have a concave shape and a projection of a first lock portion and a recess of the second lock portion may be fit.

(3) Although the pair of lock arms 58 are provided in the above embodiment, one, three or more lock arms may be provided.

(4) Although the first lock portion 38 is provided on a part of the exposed surface 36 in the above embodiment, the first lock portion 38 has only to be provided on the side of the busbar 30. For example, a first lock portion may be provided to entirely cover an exposed surface.

(5) Although the first lock portion 38 is directly provided on the exposed surface 36 in the above embodiment, the first lock portion 38 has only to be provided on the side of the exposed surface 36. For example, a first lock portion and an exposed surface may be separated.

(6) In the above embodiment, a configuration in which the first lock portion 38 is directly provided on the exposed surface 36 means that the first lock portion 38 is stacked in contact with the exposed surface 36. Note that the first lock portion 38 has only to be provided on the side of the exposed surface 36 as described above. It goes without saying that, for example, an intermediate layer (not shown) may be provided between a first lock portion and an exposed surface.

(7) Although the first lock portion 38 is integrated with the housing 12 in the above embodiment, it goes without saying that a first lock portion may be formed separately. For example, a housing and an exposed surface may be bonded via an intermediate layer.

LIST OF REFERENCE NUMERALS

10: connector
12: housing
16: retainer (mounting member)
30: busbar
36: exposed surface
38: first lock portion
40: first tapered surface
42: holding wall
46: third lock portion
48: third tapered surface
58: lock arm
60: second lock portion
62: second tapered surface
64: fourth lock portion
66: fourth tapered surface

What is claimed is:

1. A connector, comprising:
a housing including a busbar; and
a mounting member to be mounted into the housing,
wherein:
the housing includes a first lock portion,
the mounting member includes a second lock portion to be engaged with the first lock portion,
the first lock portion is provided on an exposed surface side of the busbar, and
the housing is provided with holding walls connected to both side surfaces of the first lock portion intersecting a mounting direction of the mounting member.

2. The connector according to claim 1, wherein the second lock portion is provided at a position facing an exposed surface of the busbar.

3. The connector according to claim 1, wherein the first lock portion is provided on at least a part of an exposed surface of the busbar.

4. A connector, comprising:
a housing made of resin;
a busbar made of conductive metal, the busbar being embodied in the housing; and
a separate mounting member to be mounted into the housing,
wherein:
a first lock portion is provided to project in the housing,
the mounting member is provided with a second lock portion for locking the mounting member in the housing by coming into contact with the first lock portion, a plate surface of the busbar has an exposed surface exposed to outside, the first lock portion is integrated with the housing and directly provided on the exposed surface of the busbar, and the housing is provided with holding walls connected to both side surfaces of the first lock portion intersecting a mounting direction of the mounting member.

5. The connector according to claim 4, wherein:

the mounting member includes a lock arm cantilevered in a mounting direction into the housing, and the second lock portion is provided to project in a direction from an end part of the lock arm toward the exposed surface of the busbar.

6. The connector according to claim 5, wherein:

a pair of the lock arms are provided and facing each other, the second lock portion is provided on one of the lock arms and provided to project in a direction opposite to a direction toward the facing other lock arm, a third lock portion is provided to project in the housing, and the other lock arm is provided with a fourth lock portion projecting from an end part of the other lock arm in a direction opposite to a direction toward the facing one lock arm and configured to lock the mounting member in the housing by coming into contact with the third lock portion.

7. The connector according to claim 5, wherein the first lock portion is provided with a first tapered surface inclined from an end part in a projecting direction of the first lock portion toward the exposed surface of the busbar in a direction opposite to a mounting direction of the mounting member.

8. The connector according to claim 5, wherein the second lock portion is provided with a second tapered surface inclined from an end part in a projecting direction of the second lock portion toward a tip part of the lock arm in a mounting direction of the mounting member.

* * * * *